US010390585B2

(12) United States Patent
Lee et al.

(10) Patent No.: US 10,390,585 B2
(45) Date of Patent: Aug. 27, 2019

(54) SHOE

(71) Applicant: Because International, Corp., Nampa, ID (US)

(72) Inventors: Kenton A. Lee, Nampa, ID (US); Gary A. Pitman, Vancouver, WA (US); Todd A. Miller, Tualatin, OR (US)

(73) Assignee: BECAUSE INTERNATIONAL, Nampa, ID (US)

( * ) Notice: Subject to any disclaimer, the term of this patent is extended or adjusted under 35 U.S.C. 154(b) by 118 days.

(21) Appl. No.: 15/697,077

(22) Filed: Sep. 6, 2017

(65) Prior Publication Data

US 2017/0360144 A1 Dec. 21, 2017

Related U.S. Application Data

(63) Continuation of application No. 29/536,629, filed on Aug. 18, 2015, now Pat. No. Des. 829,418.

(51) Int. Cl.

| | |
|---|---|
| ***A43B 3/12*** | (2006.01) |
| ***A43B 3/26*** | (2006.01) |
| ***A43C 11/14*** | (2006.01) |
| ***A43B 23/02*** | (2006.01) |
| ***A43B 3/24*** | (2006.01) |

(52) U.S. Cl.

CPC ..... *A43B 3/26* (2013.01); *A43B 3/122* (2013.01); *A43B 3/126* (2013.01); *A43B 3/128* (2013.01); *A43B 3/248* (2013.01); *A43B 23/0295* (2013.01); *A43C 11/14* (2013.01)

(58) Field of Classification Search

CPC ..... A43B 3/12; A43B 3/122; A43B 3/126; A43B 3/128; A43B 23/0295; A43B 23/081

USPC ..... 36/11.5

See application file for complete search history.

(56) References Cited

U.S. PATENT DOCUMENTS

| | | | | |
|---|---|---|---|---|
| D83,898 S | | 4/1931 | Golden | |
| 2,193,943 A | * | 3/1940 | Shea | A43B 3/124 36/11.5 |
| 2,206,001 A | * | 6/1940 | Cohen | A43B 3/126 36/11.5 |
| 2,421,818 A | * | 6/1947 | Tibiletti | A43B 3/126 36/11.5 |
| D147,311 S | | 8/1947 | Veach | |
| 2,444,822 A | | 7/1948 | Griffin | |
| D150,568 S | | 8/1948 | Griffin | |
| D156,604 S | | 12/1949 | Codish | |
| D165,116 S | | 11/1951 | Sloan et al. | |

(Continued)

OTHER PUBLICATIONS

Because International Facebook post, Image, Dec. 20, 2013.

(Continued)

*Primary Examiner* — Marie D Bays

(74) *Attorney, Agent, or Firm* — Price Heneveld LLP

(57) ABSTRACT

A shoe that grows comprises a sole having a toe, medial side, lateral side, and heel. The toe of the sole extends outwardly to form a toe cap. A vamp member is adjustably connected to a free end of the toe cap. At least one medial strap connects the vamp member to the medial side of the sole. At least one lateral strap connects the vamp member to the lateral side of the sole. An adjustable heel strap connects to the medial and lateral sides of the sole and extends around the heel of the sole.

20 Claims, 6 Drawing Sheets

(56) References Cited

U.S. PATENT DOCUMENTS

| | | | | | |
|---|---|---|---|---|---|
| 2,588,061 | A * | 3/1952 | Vesely | A43B 3/122 | 123/65 VD |
| D166,785 | S | 5/1952 | Wiseman | | |
| 2,630,636 | A | 3/1953 | Cockrell | | |
| 5,423,134 | A * | 6/1995 | Bagnaia | A43B 3/128 | 36/101 |
| D379,709 | S | 6/1997 | Francis et al. | | |
| 5,836,090 | A * | 11/1998 | Smith | A43B 3/128 | 36/7.6 |
| D459,862 | S * | 7/2002 | Butler | D2/916 | |
| D460,245 | S * | 7/2002 | Butler | D2/916 | |
| 6,493,965 | B1 * | 12/2002 | Bathum | A43B 3/126 | 36/11.5 |
| 7,055,265 | B1 * | 6/2006 | Bathum | A43B 5/08 | 36/11.5 |
| 7,121,020 | B1 * | 10/2006 | Bathum | A43B 3/128 | 36/102 |
| 7,222,440 | B2 * | 5/2007 | Dombowsky | A43B 3/16 | 36/11.5 |
| 7,788,827 | B2 * | 9/2010 | Fogg | A43B 3/128 | 36/103 |
| 2002/0007570 | A1 * | 1/2002 | Girard | A43C 1/00 | 36/88 |
| 2003/0182820 | A1 * | 10/2003 | Fuerst | A43B 1/0027 | 36/11.5 |
| 2006/0288610 | A1 * | 12/2006 | Laska | A43B 3/102 | 36/11.5 |
| 2017/0360144 | A1 * | 12/2017 | Lee | A43B 3/248 | |

OTHER PUBLICATIONS

Because International Facebook post, Shared Article from Idaho Press-Tribune, "Donate pair of shoes through Idaho Gives," Apr. 30, 2014.

* cited by examiner

SHOE

PRIORITY CLAIM

This application is a continuation of U.S. Design patent application Ser. No. 29/536,629 filed Aug. 18, 2015, and issued as U.S. Pat. No. D829,418, on Oct. 2, 2018, which is hereby incorporated by reference.

FIELD OF THE INVENTION

This disclosure relates to footwear.

BACKGROUND OF THE INVENTION

There is a need for a shoe that grows.

SUMMARY OF THE INVENTION

A basic embodiment of the invention is a shoe that grows comprising a sole having a toe, medial side, lateral side, and heel, which wrap upwardly. The toe of the sole extends outwardly, upwardly, and rearwardly to form a toe cap. A vamp member is adjustably connected to a free end of the toe cap. Plural medial straps connect the vamp member to the medial side of the sole. Plural lateral straps connect the vamp member to the lateral side of the sole. An adjustable heel strap is connected to the medial and lateral sides of the sole and extends around the heel of the sole. The sole is configured to be wrapped upwardly on the medial and lateral sides. The sole can have an outsole that can extend onto the top cap portion of the sole.

The vamp and the toe cap portion of the sole are adjustably connected with a hitch fastener comprising a hitch configured to engage with one of a plurality of holes in a free end of the toe cap. According to the basic embodiment, the medial and lateral straps are connected to the vamp member and thread through slots in the medial and lateral sides of the sole, respectively. The medial and lateral straps are each secured with a fastening device. A backstay is connected to and extends upwardly from the heel of the sole. The heel strap can be connected to the backstay. The heel strap includes a buckle.

Further objects and advantages of the invention will be apparent from the drawings and description thereof.

DETAILED DESCRIPTION OF A BASIC EMBODIMENT

Figure 1:
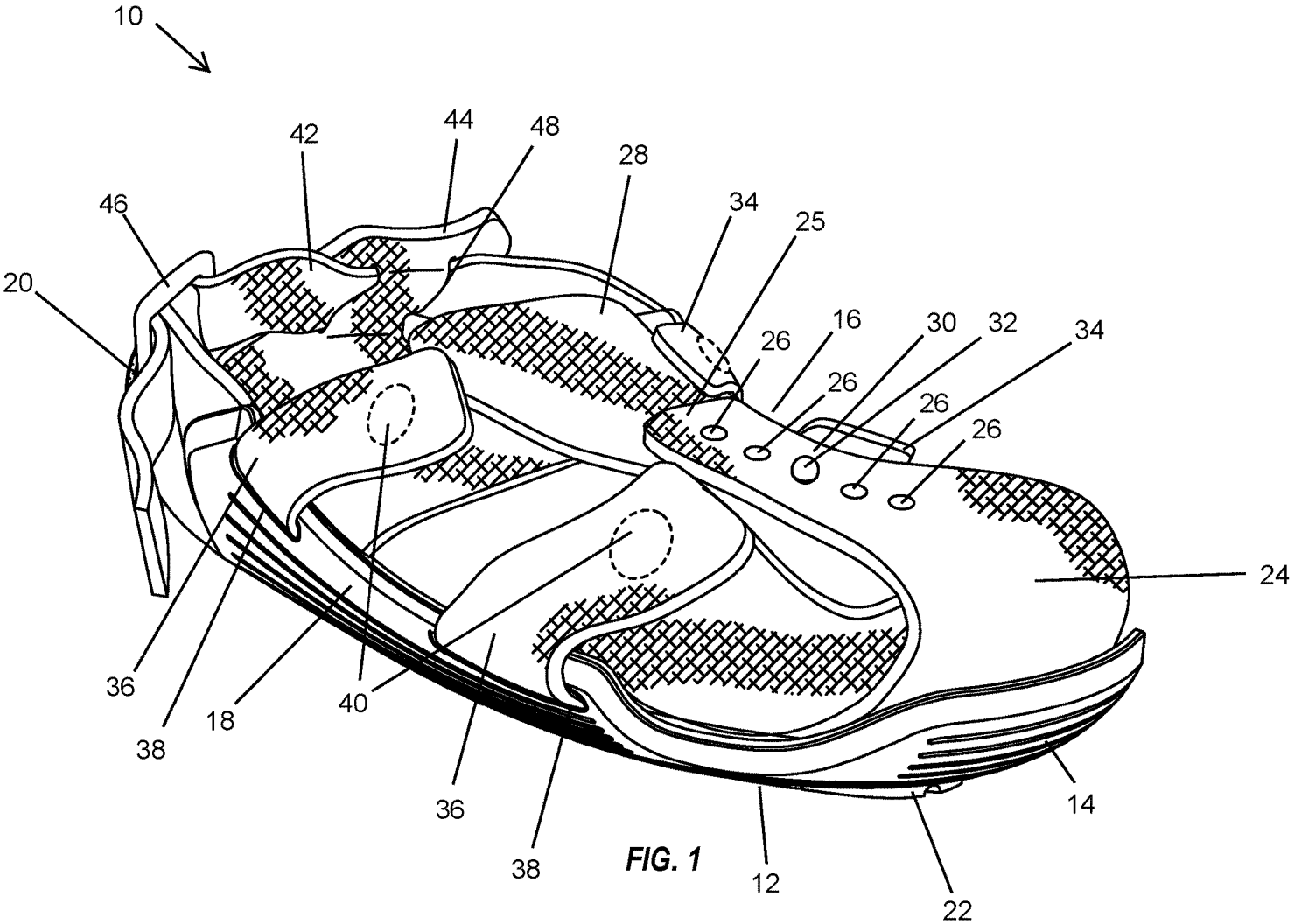
FIG. 1 is a front perspective view of the shoe.
Figure 2:
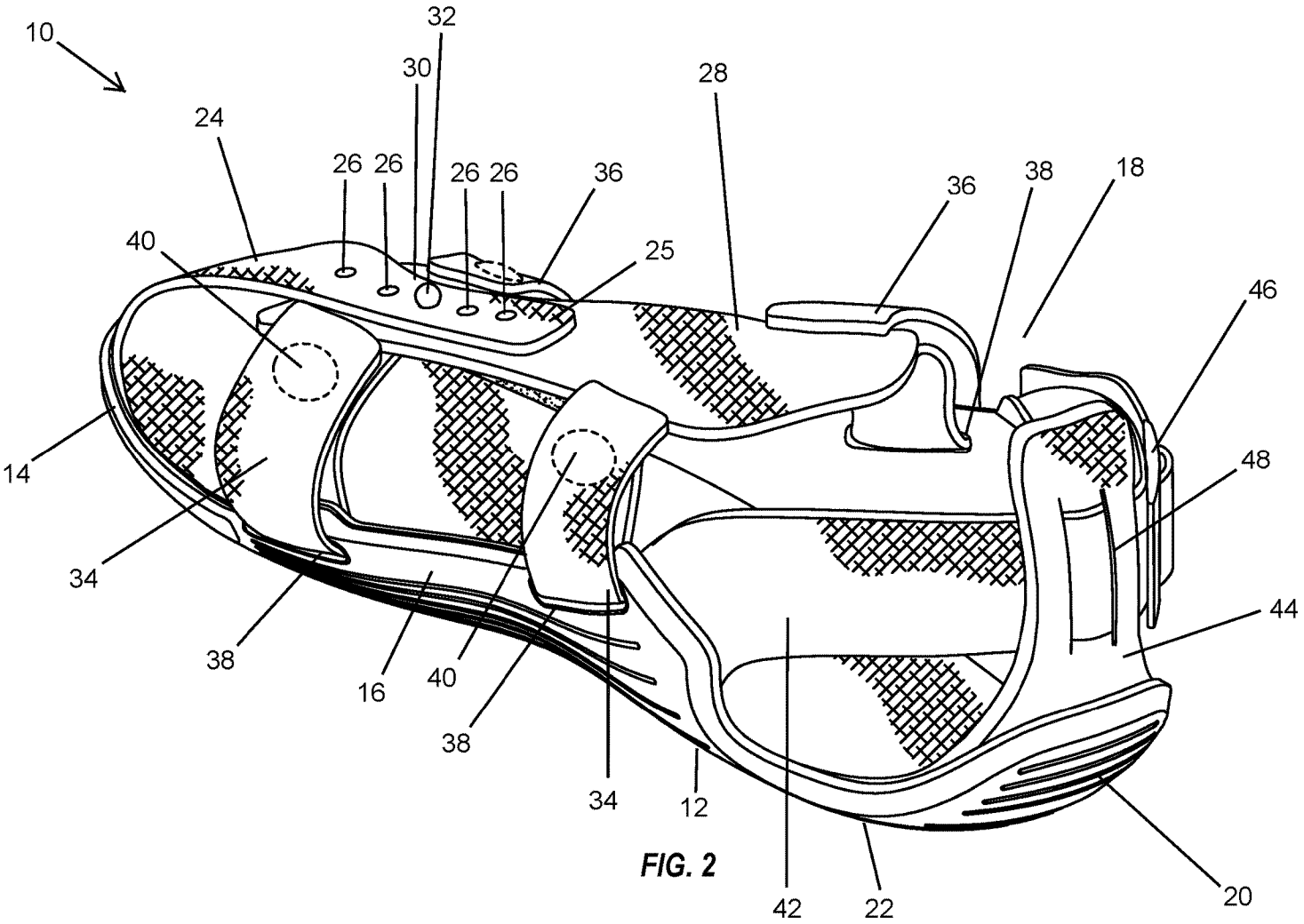
FIG. 2 is a rear perspective view of the shoe.
Figure 3:
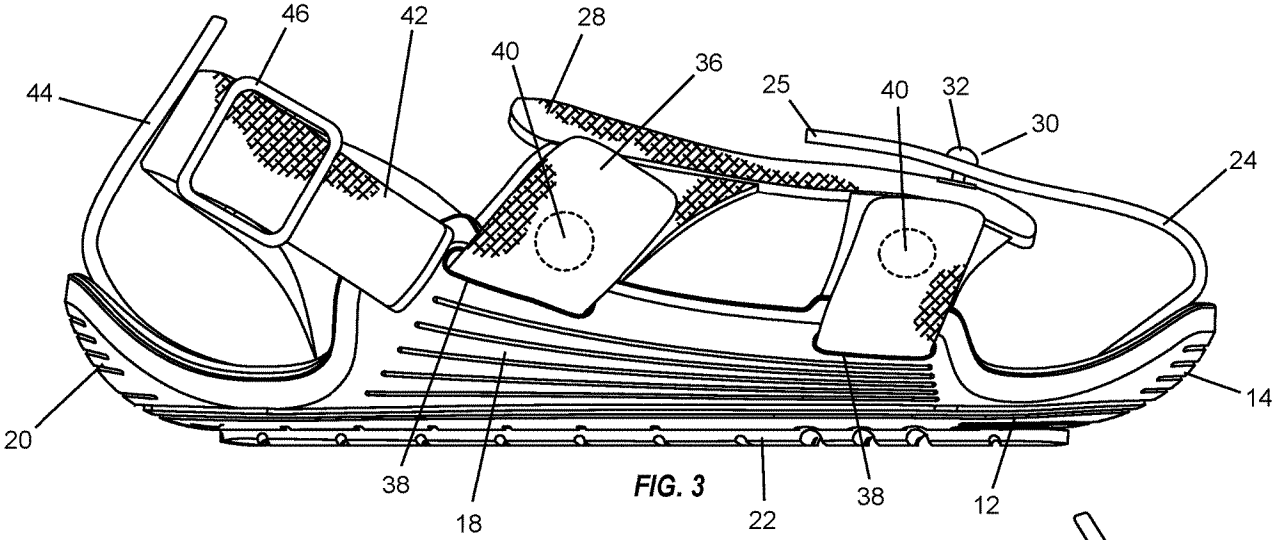
FIG. 3 is a right elevation of the shoe.
Figure 4:
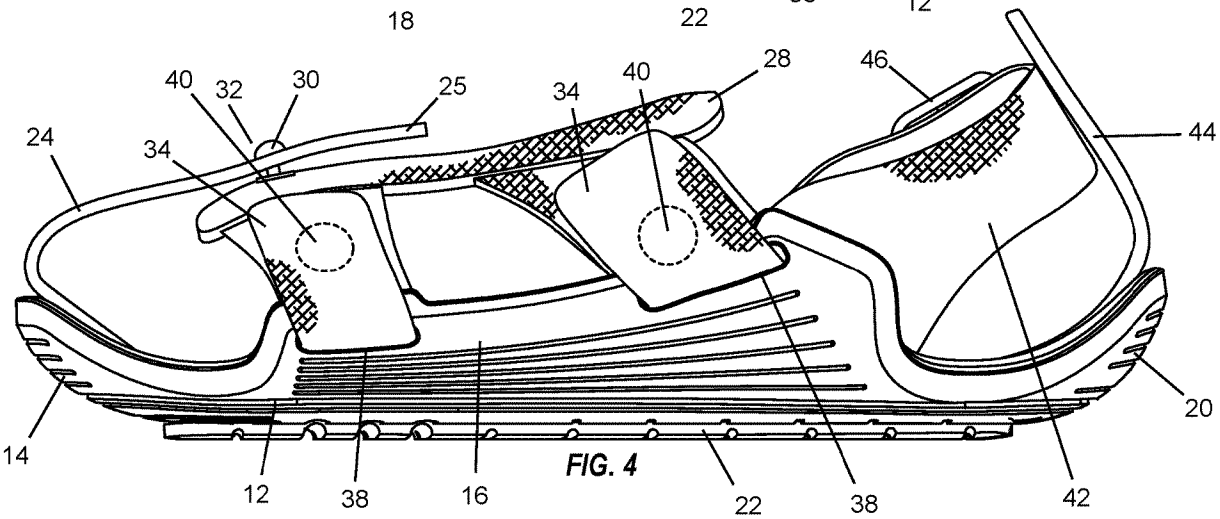
FIG. 4 is a left elevation of the shoe.
Figure 5:
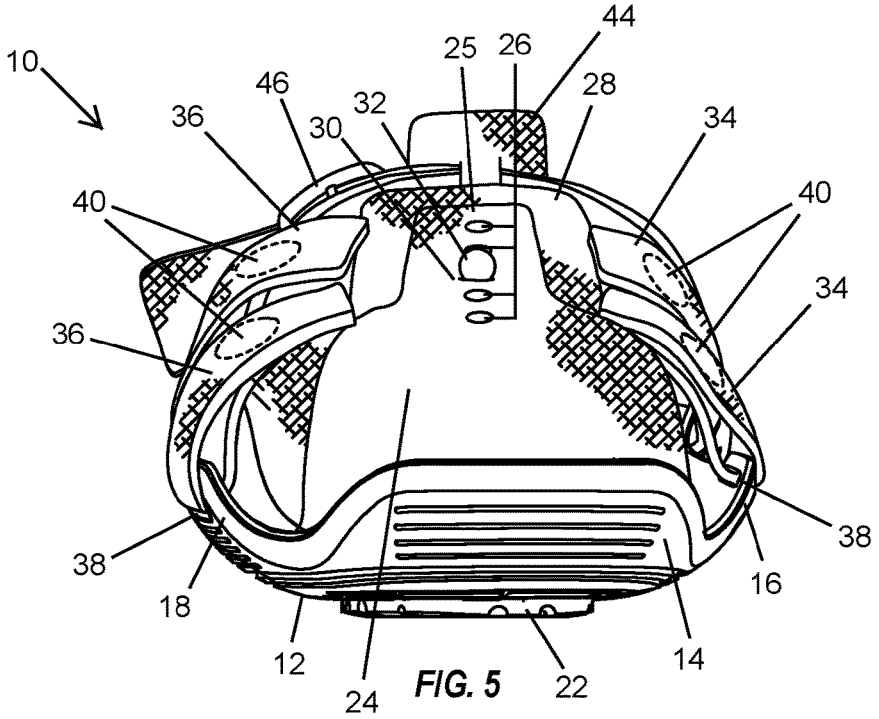
FIG. 5 is a front elevation of the shoe.

FIGS. 1-8 show a basic embodiment of a shoe 10 that can grow. The shoe depicted in FIGS. 1-8 is a right shoe, the left shoe being a mirror image thereof. The shoe 10 has a sole 12 having a toe 14, a medial side 16, a lateral side 18, and a heel 20.

The sole 12 is configured to be wrapped upwardly on the medial 16 and lateral 18 sides, as shown in FIGS. 1-6. In the illustrated embodiment, the sole 10 includes an outsole 22. The toe of the sole extends outwardly and is configured to wrap upwardly and backwardly to form a toe cap 24, as best shown in FIGS. 1-4. The toe cap 24 is an integral extension of sole 12. The toe cap 24 has a plurality of longitudinally spaced holes 26 in a free end 25. The outsole 22 extends onto the toe cap 24.

The article of footwear 10 has a vamp member 28 adjustably connected by a hitch fastener 30 to the free end 25 of the toe cap 24. The fastener 30 has at least one hitch 32 which is configured to engage with a selected one of the plurality of holes 26 in free end 25 of toe cap 24.

First and second medial straps 34 connect the vamp member 28 to the medial side of sole 12. First and second lateral straps 36 connect vamp member 28 to the lateral is side of sole 12. The medial 34 and lateral straps 36 are configured such that one end of the straps is connected to vamp member 28 and the straps extend through slots 38 in the medial side 16 and lateral side 18, respectively, of the sole 12. In the illustrated embodiment, medial strap 34 and lateral strap 36 are secured to themselves with fastening devices 40, as shown in FIGS. 2-5.

Figure 6:
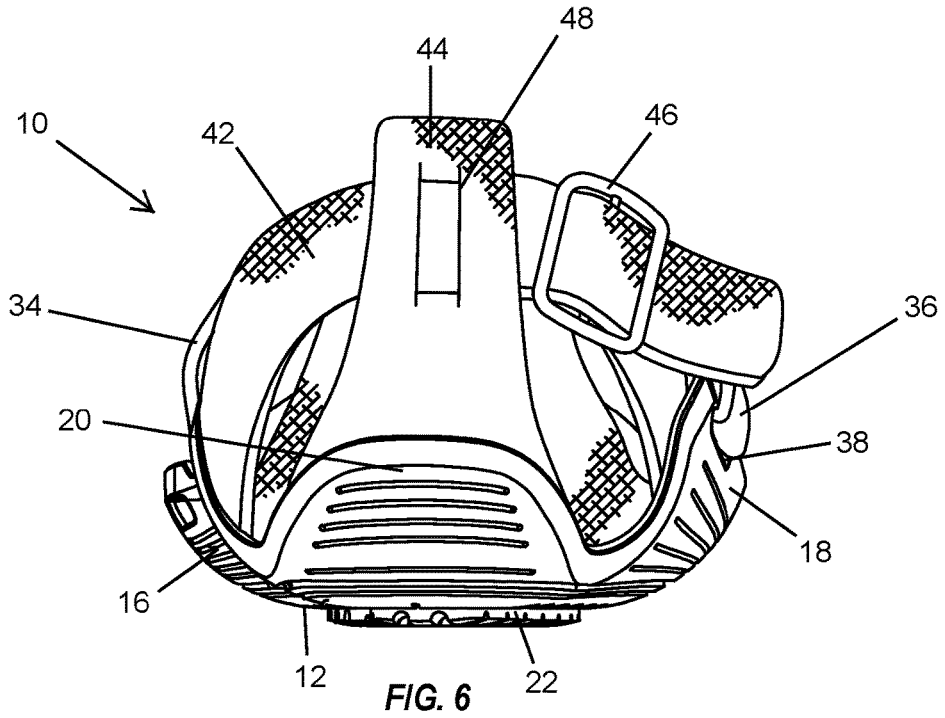
FIG. 6 is a rear elevation of the shoe.
Figure 7:
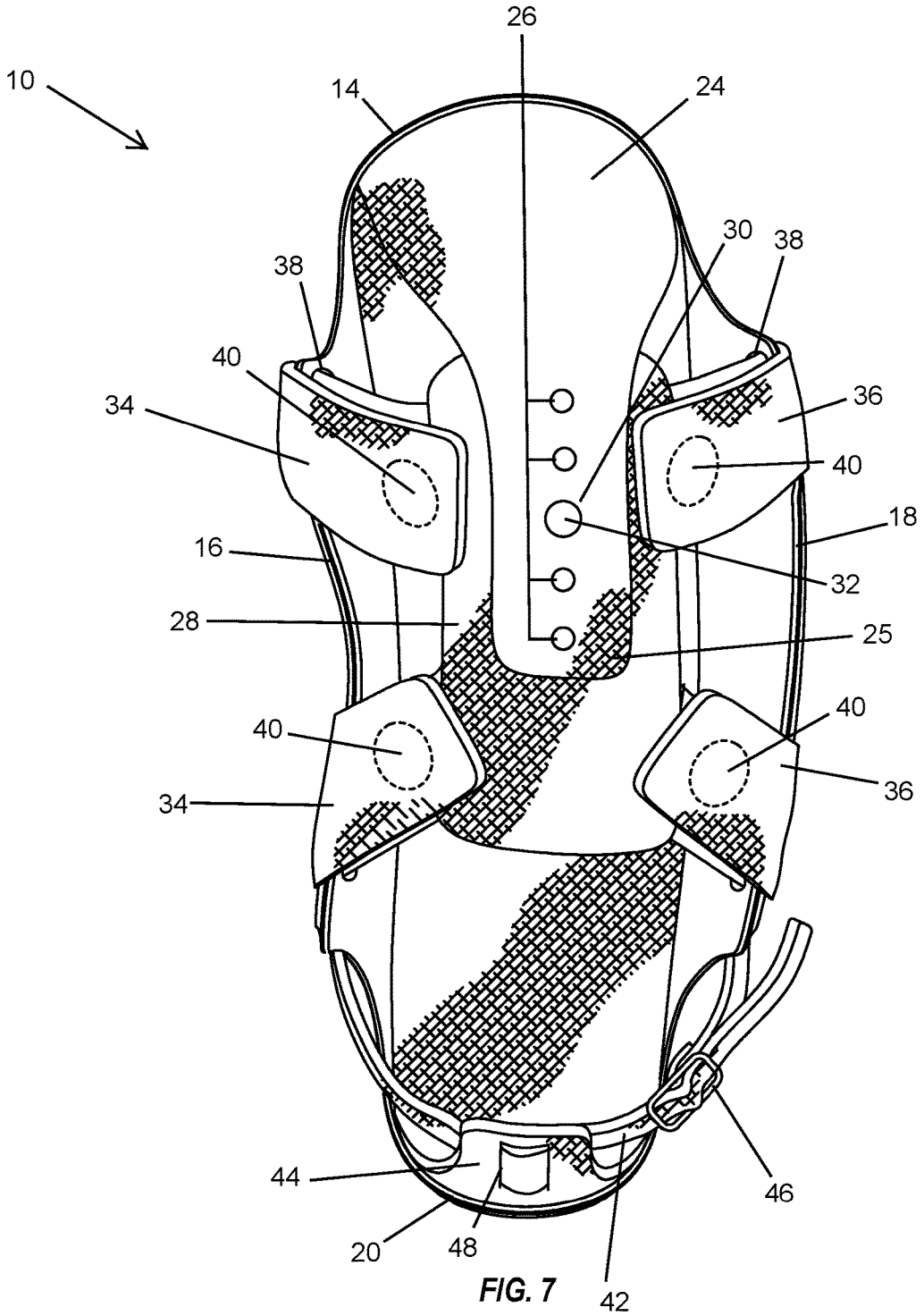
FIG. 7 is a top plan view of the shoe.
Figure 8:
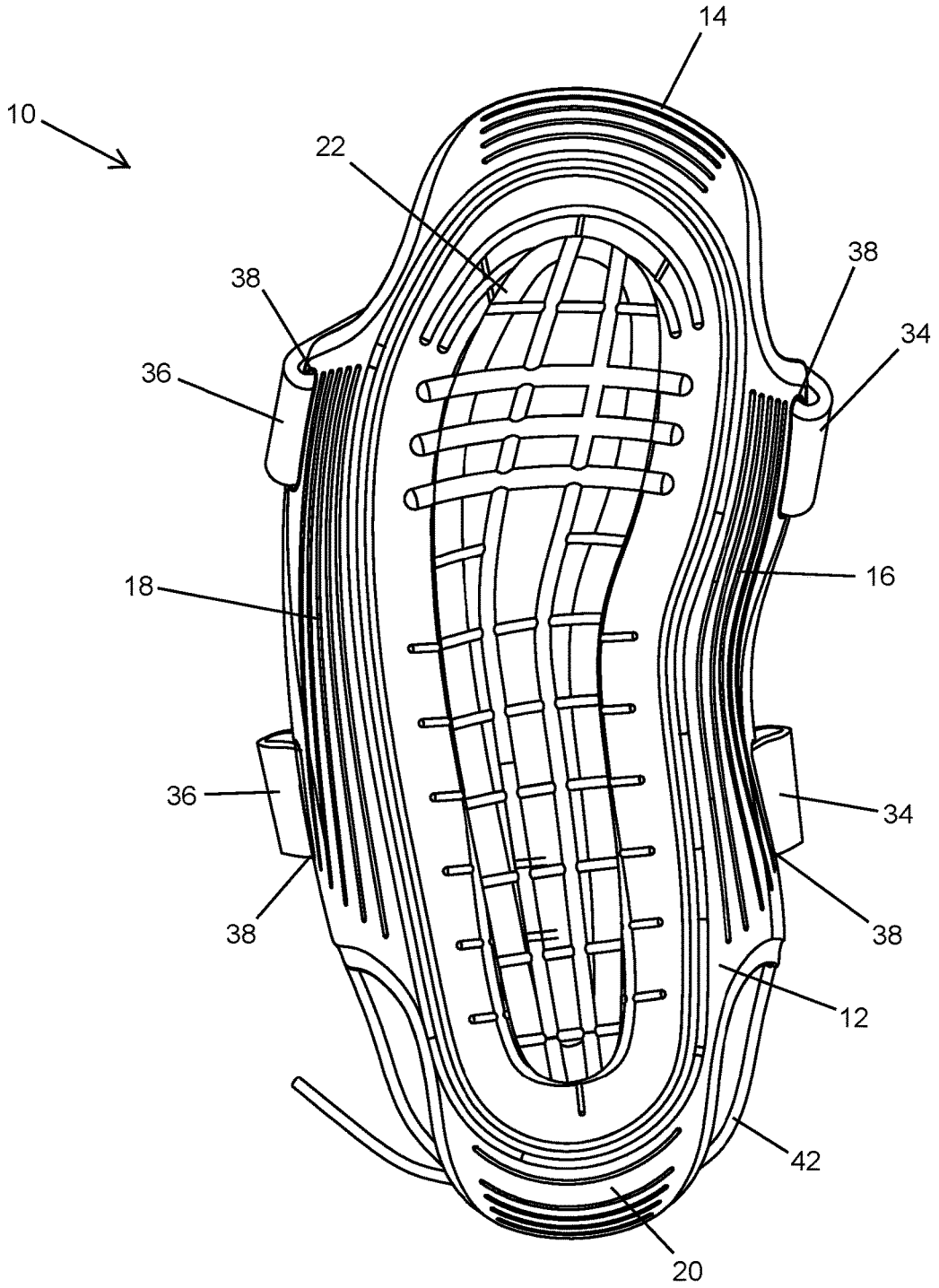
FIG. 8 is a bottom plan view of the shoe.

An adjustable heel strap 42 extends around the heel 20 from the medial side 16 of sole 12 to the lateral side 18 of the sole. A backstay 44 is connected to the heel 20 of the sole 12 and includes several vertical slits 48. The heel strap 42 is connected to the backstay by threading the strap through the slits in the backstay 44 as best shown in FIG. 6. In the illustrated embodiment, the heel strap 42 includes a buckle 46.

While an embodiment of the invention has been herein illustrated and described, it is to be appreciated that certain changes, rearrangements and modifications may be made therein without departing from the scope of the invention as defined by the appended claims.

What is claimed is:

1. An article of footwear comprising:
- a sole having a toe, medial side, lateral side, and heel, wherein at least the toe, medial side and lateral side of the sole extend and wrap upwardly;
- a toe cap extending from the toe of the sole;
- a vamp member adjustably connected to a free end of the toe cap;
- at least one medial strap connecting the vamp member to the medial side of the sole;
- at least one lateral strap connecting the vamp member to the lateral side of the sole; and
- an adjustable heel strap connected to the medial and lateral sides of the sole and extending around the heel of the sole.

2. The article of footwear of claim 1, further comprising a backstay connected to the heel of the sole and the heel strap.

3. The article of footwear of claim 1, wherein the at least one lateral strap is secured to itself with a fastening device.

4. The article of footwear of claim 1, wherein the at least one medial strap is secured to itself with a fastening device.

5. The article of footwear of claim 1, further comprising a buckle on the heel strap.

6. The article of footwear of claim 1, wherein the toe cap is an integral extension of the sole.

7. The article of footwear of claim 1, wherein the vamp member is adjustably connected to the free end of the toe cap with a hitch fastener.

8. The article of footwear of claim 7, wherein the free end of the toe cap includes a plurality of longitudinally spaced holes and the hitch fastener includes at least one hitch that is configured to engage with at least one of the holes in the free end of the toe cap.

9. The article of footwear of claim 1, wherein one end of the at least one medial strap is connected to the vamp member and the other end of the medial strap extends through a slot in the medial side of the sole and is secured with a fastening device.

10. The article of footwear of claim 1, wherein one end of the at least one lateral strap is connected to the vamp member and the other end of the medial strap extends through a slot in the lateral side of the sole and is secured with a fastening device.

11. The article of footwear of claim 1 wherein the sole includes an outsole.

12. The article of footwear of claim 11 wherein the outsole extends onto the toe cap.

13. An article of footwear comprising:

a sole having a toe, medial side, lateral side, and heel;

the sole comprising a toe cap that is an integral extension of the toe of the sole, the toe cap having a free end with a plurality of longitudinally spaced holes;

a vamp member;

at least one hitch connected to the vamp member that is configured to engage a selected one of the holes in the free end of the toe cap;

a plurality of medial straps connecting the vamp member to the medial side of the sole;

a plurality of lateral straps connecting the vamp member to the lateral side of the sole;

an adjustable heel strap connected to the medial and lateral sides of the sole and extending around the heel of the sole; and a backstay connected to the heel of the sole and the heel strap.

14. The article of footwear as in claim 13 wherein the sole includes an outsole that extends onto the toe cap.

15. An article of footwear as in claim 13 wherein the medial and lateral sides of the sole extend and wrap upwardly.

16. An article of footwear comprising:

a sole having a toe, medial side, lateral side, and heel;

the sole comprising a toe cap that is an integral extension of the toe of the sole, the toe cap having a free end;

a vamp member;

at least one fastener connecting the free end of the toe cap to the vamp member;

a plurality of medial straps connecting the vamp member to the medial side of the sole;

a plurality of lateral straps connecting the vamp member to the lateral side of the sole; and an adjustable heel strap connected to the medial and lateral sides of the sole and extending around the heel of the sole.

17. An article of footwear as in claim 16 wherein the toe and at least one of the medial and lateral sides of the sole extend and wrap upwardly.

18. An article of footwear as in claim 16 wherein the toe, medial side, lateral side and heel of the sole extend and wrap upwardly.

19. An article of footwear as in claim 18, wherein the heel strap is connected to the portions of the sole that extend and wrap upwardly on the medial and lateral sides.

20. An article of footwear as in claim 16, wherein the outsole extends onto the toe cap.

* * * * *